United States Patent [19]

Ramich

[11] 3,981,434

[45] Sept. 21, 1976

[54] EASY OPENING CARTON FOR FROZEN COMESTIBLE

[75] Inventor: Gary Allen Ramich, Neenah, Wis.

[73] Assignee: American Can Company, Greenwich, Conn.

[22] Filed: Apr. 10, 1975

[21] Appl. No.: 566,835

[52] U.S. Cl. ..... 229/51 TS; 229/14 BA

[51] Int. Cl.[2] ..... B65D 5/02; B65D 17/12

[58] Field of Search ..... 229/14 BA, 51 TS

[56] References Cited

UNITED STATES PATENTS

| | | | |
|---|---|---|---|
| 1,956,159 | 4/1934 | Reilly et al. | 229/14 BA UX |
| 2,856,114 | 10/1958 | Guyer | 229/14 BA |
| 3,096,918 | 7/1963 | Van Dyke et al. | 229/51 TS X |
| 3,315,870 | 4/1967 | Barnes | 229/51 TS X |
| 3,464,832 | 9/1969 | Mullinik | 229/51 TS X |
| 3,478,868 | 11/1969 | Neremberg et al. | 229/14 BA X |
| 3,580,466 | 5/1971 | Thelen | 229/14 BA |
| 3,833,165 | 9/1974 | Hoiles | 229/51 TS |

FOREIGN PATENTS OR APPLICATIONS

| | | | |
|---|---|---|---|
| 651,573 | 1/1963 | Italy | 229/14 BA |
| 1,018,420 | 1/1966 | United Kingdom | 229/14 BA |

*Primary Examiner*—Davis T. Moorhead

*Attorney, Agent, or Firm*—Robert P. Auber; Frank S. Charlton; Ira S. Dorman

[57] ABSTRACT

A trunk-style carton for ice cream and the like which displays greater ease in opening and superior protective properties for the product, after removal of a portion of the carton contents and reclosure of the carton, by virtue of a liner sheet beneath the carton cover which covers the upper surface of the carton contents completely and is adhered at one end to the upper portion of the inner surface of the carton back wall and at the other end to a zipper strip or a bonding portion of the inner surface of the carton front cover panel.

5 Claims, 9 Drawing Figures

EASY OPENING CARTON FOR FROZEN COMESTIBLE

BACKGROUND OF THE INVENTION

The present invention relates to a carton construction of particular utility in the packaging of ice cream and similar frozen comestibles and, in greater particularity, to a paperboard trunk-style ice cream carton having a partial liner of a flexible, water-resistant sheet material so positioned and adhered to the inner surface of the carton blank as to provide easy opening of the carton cover and added protection to the frozen contents both before and after the removal of a portion thereof.

Ice cream and similar frozen confections are commonly packaged in trunk-style cartons made of waxed or polymer-coated paperboard. The cartons have a cover hinged to a wall of the main receptacle, and the cover is provided on the non-hinged sides with a skirt which overlies the upper portions of three of the receptacle walls. An extension of the front cover skirt panel is adhered to the front receptacle wall to seal the carton and a so-called zipper strip defined by two substantially parallel weakness lines lies interposed between the adhered area and the cover skirt. Upon removal of the zipper opening strip by severance of the weakness lines, the cover may be lifted to give access to the contents. It has been found, however, that the cover is often adhered so tightly to the frozen contents of the carton that it is difficult to raise the cover without tearing some of its component parts. Furthermore, once the carton has been opened, a portion of the contents removed, and the cover reclosed for storage of the remainder in a freezer, the surface of the remaining ice cream tends to ice off and to desiccate because the carton is no longer in intimate contact with the product.

SUMMARY OF THE INVENTION

These problems related to the packaging and storage of ice cream, sherbet and other similar frozen dessert items are substantially alleviated by the carton of the present invention in which a liner sheet is attached to the upper portion of the receptacle rear wall on the inside surface thereof and extends across the inner surface of the cover and the inner surface of the front cover skirt panel and is adhered, in the preferred embodiment, to the inner surface of the zipper strip which constitutes the opening feature of the carton. The adhesion of the liner to the inner zipper strip surface is achieved by means of an adhesive which forms firm bonds at room temperature and above, but which is very temperature sensitive so that the bond between the liner sheet and the coated paperboard fails completely or is so weakened as to be completely ineffectual at normal freezer temperatures (0° F.).

Figure 1:
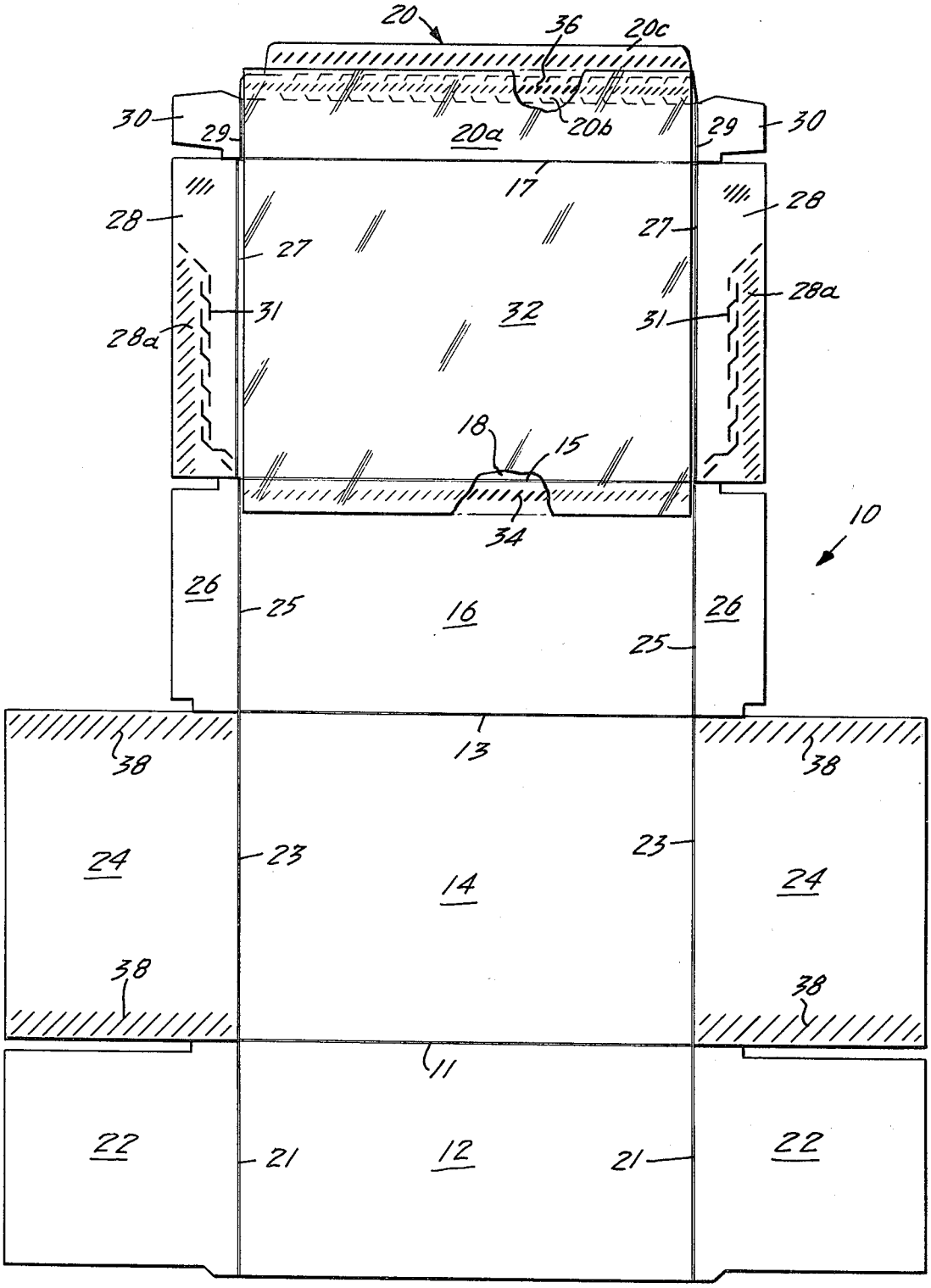
Figure 2:
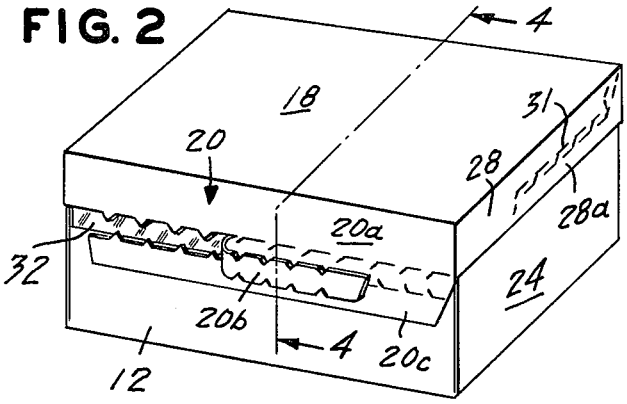
Figure 3:
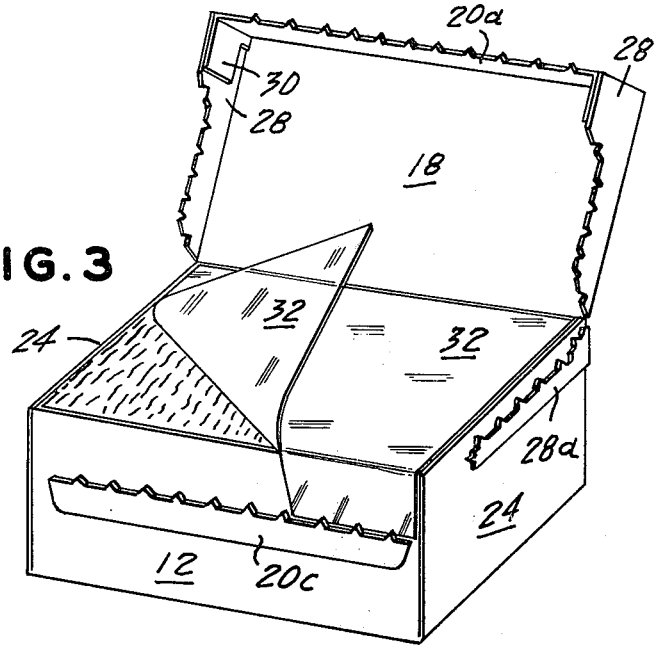
Figure 4:
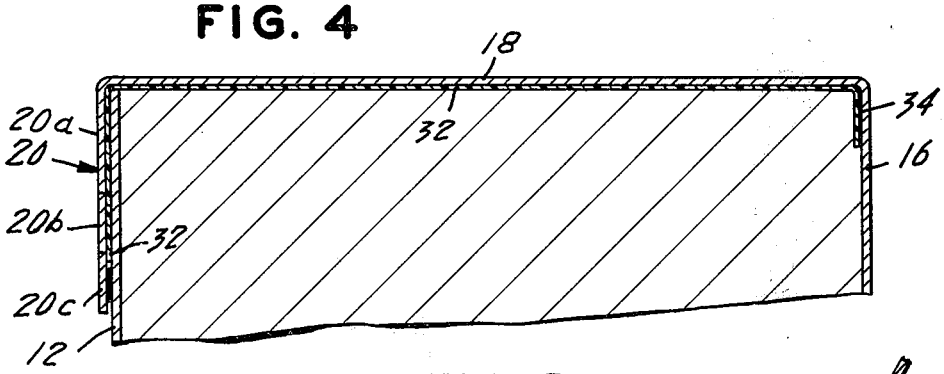
Figure 5:
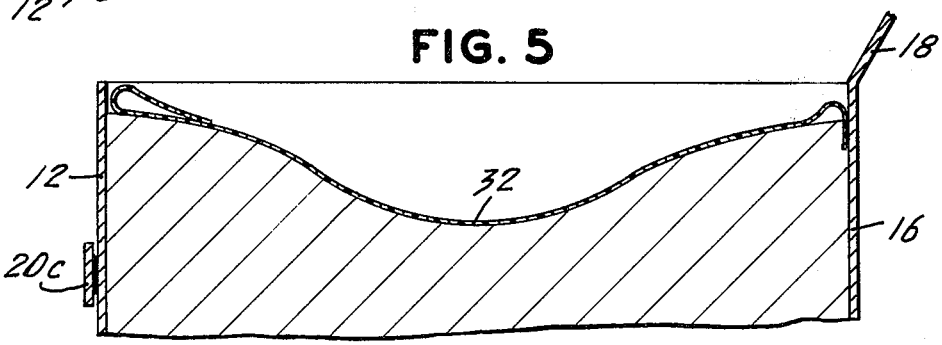
Figure 6:
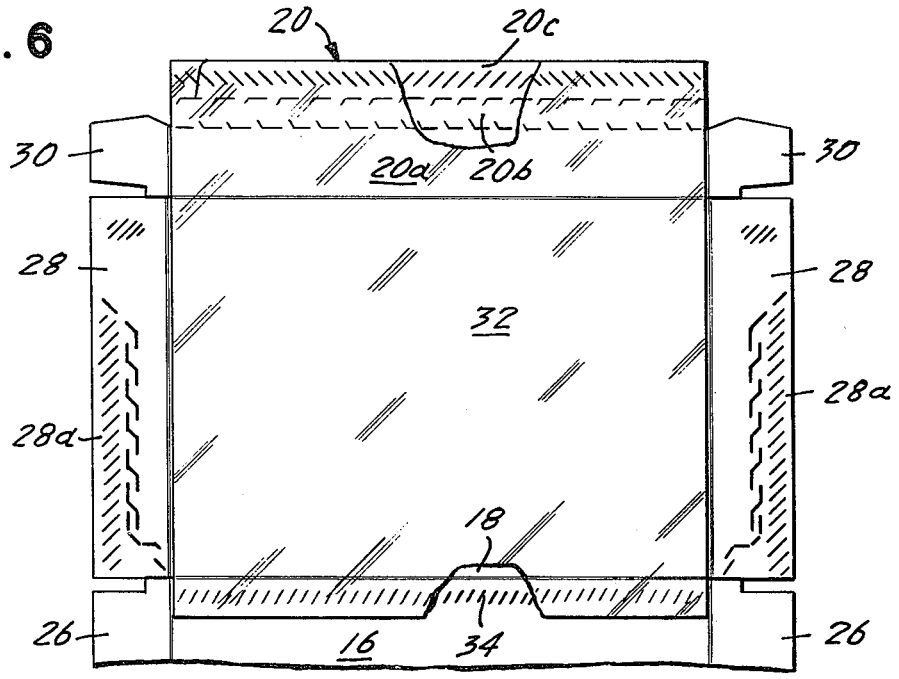
Figure 7:
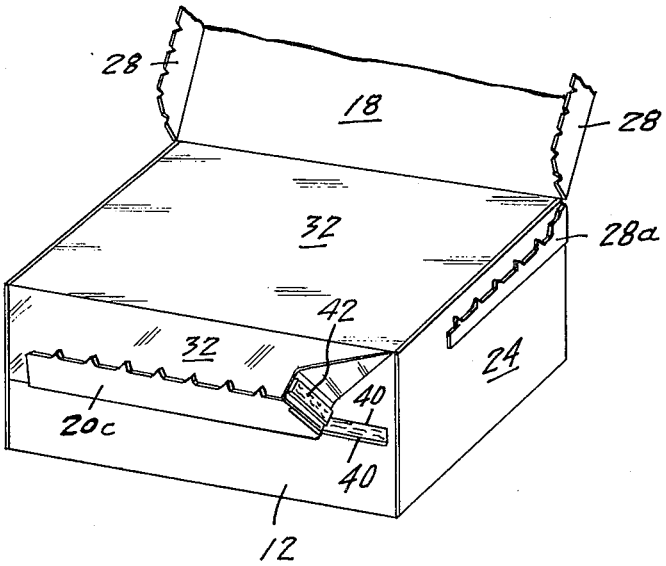
Figure 8:
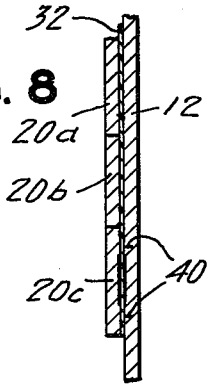
Figure 9:
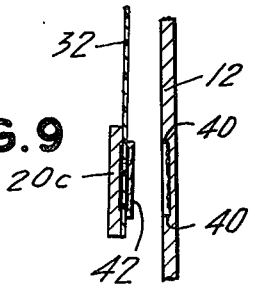

The various novel features of the present invention may be most readily appreciated from a consideration of the following description together with the accompanying drawings in which:

FIG. 1 is a plan view of the interior surface of a carton blank in accord with a preferred form of the invention, FIG. 2 is a perspective view of a sealed carton with the zipper strip forming the opening feature partially removed, FIG. 3 is a perspective view of a carton with the cover opened and the protective plastic film partially lifted, FIG. 4 is a cross-sectional view of the carton of this invention taken along line 4—4 of FIG. 2, FIG. 5 is a similar cross-sectional view taken after the carton has been opened, some of the contents removed and the liner film replaced on the surface of the remaining contents, FIG. 6 is a plan view of the cover and a portion of the back wall of a blank illustrating an alternate embodiment of the invention, FIG. 7 is a perspective view, partially cut away, of an opened carton according to the alternate embodiment, FIG. 8 is a cross-sectional view of a portion of the front wall of the carton along line 8—8 of FIG. 7 prior to opening the carton, and FIG. 9 is a cross-sectional view comparable to FIG. 8 during the opening process.

DESCRIPTON OF A PREFERRED EMBODIMENT OF THE INVENTION

In a preferred embodiment of the invention, the carbon blank, generally indicated by the number 10 in FIG. 1, is formed of a single piece of paperboard which is suitably cut and scored to form, hingedly attached in sequence along parallel hinge score lines 11, 13, 15 and 17, respectively, a receptacle front wall 12, bottom wall 14, rear wall 16, a top cover panel 18 and a front cover panel 20. The front cover panel 20 is comprised of three portions: an upper, cover front skirt portion 20a, an intermediate, detachable zipper stip portion 20b, and a lower or remote bonding portion 20c. Hingedly connected to opposite end edges of the front wall 12 along score lines 21 are opposed receptacle forward inner end wall panels 22. Hingedly attached to opposite end edges of the bottom wall 14 along score lines 23 are opposed receptacle outer end walls 24. Hingedly attached to opposite end edges of rear wall 16 along score lines 25 are opposed receptacle rearward inner end wall panels 26. Hingedly attached to the opposite end edges of top cover panel 18 along hinge lines 27 are cover end skirt panels 28, and hingedly attached to the opposite end edges of the cover front skirt portion 20a of front cover panel 20 along score lines 29 are corner glue tabs 30. A liner sheet or pellicle 32 of a smooth-surfaced, water-resistant, flexible sheet material such as a plastic film, metallic foil or coated paper sheet 32, substantially equal in width to the distance between the paired score lines 25—25, 27—27 and 29—29 is adhered to the inner surface of the receptacle rear wall 16 by adhesive 34 positioned a short distance below the hinge line 15 between the receptacle rear wall 16 and the top cover panel 18. The liner sheet 32 extends across the top cover panel 18, across the cover front skirt portion 20a of front cover panel 20 and is adhered by a special adhesive 36 applied to the inner surface of the detachable portion 20b of front cover panel 20, as will be discussed in greater detail hereinafter.

Cover end skirt panels 28 have an adhesion area 28a at the lower rear portion of the panels, defined by a weakness line 31 which extends from a point on the free edge of skirt panel 28 remote from hinge line 27 upwardly and rearwardly to a point on the rear edge of panel 28 substantially adjacent to hinge line 27.

In erecting the carton blank into a receptacle, adhesive is first applied to selected areas 38 on the inner surface of outer end walls 24, the front wall 12 and rear wall 16 are swung into perpendicular relationship to bottom wall 14, the inner end wall panels 22 and 26 are swung inward into abutting relationship and outer end walls 24 are swung upward to become adhesively engaged with the outer surface of the inner end wall panels 22 and 26, thus completing the erection of the receptacle portion of the carton, which is then ready to be filled with ice cream or similar product.

After filling the receptacle with the desired product, adhesive is applied to areas 28*a* of cover end skirt panels 28, to the forward corner portions of cover end skirt panels 28, and also to the bonding portion 20c of the front cover panel 20. Top cover panel 18 may then be brought into overlying relationship to the product with film 32 in intimate contact therewith, after which the front cover panel 20 is swung downward to overlie the upper portion of receptacle front wall 12 with bonding portion 20*c* of panel 20 being adhered to front wall 12. Complete sealing of the carton is achieved by infolding the glue tabs 30 to overlie the upper front corner of outer end walls 24 and then downfolding the cover end skirt panels 28 into adhesive superposition on the glue tabs 30 and the upper portion of outer end walls 24.

It is to be noted that ice cream and similar frozen dessert items are packaged in a semi-frozen state in which the product has sufficient fluidity to flow and conform to the shape of the carton. Immediately after filling and sealing the cartons, however, they are placed in a "hard freeze" room maintained at or below 0° F., whereupon the ice cream freezes to the solid state which the customer normally associates with products of this nature. In the course of changing the product from its semi-frozen to its hard-frozen state, the ice cream tends to form rather firm bonds to the various interior wall surfaces of the carton in which it is packaged. In opening the cartons of the prior art by lifting the top cover panel and associated skirt panels, it was often found that the product-to-carton bonds were difficult to break and damage to the carton cover frequently resulted. In the present package, however, the carton cover panel is not in direct contact with the frozen product due to the interposition of the liner sheet 32, thus removing the possibility that the cover could become securely bonded to the frozen product. Once the cover is freed for the opening operation by severing the connection between the cover front skirt portion 20*a* from the bonding portion 20*c* of front cover panel 20 by removal of the zipper strip portion 20*b* of panel 20, the cover and associated skirt portions may be readily lifted, swinging about hinge line 15 which joins the top cover panel 18 with the receptacle rear wall 16. In the course of lifting the cover, weakness lines 31 on the cover end skirt panels 28 are severed, leaving the adhesive areas 28a bonded to receptacle outer end walls 24.

The removal of the zipper strip portion 20*b* from the carton is facilitated by the fact that a special adhesive 36 is utilized to adhere the liner sheet 32 to the zipper strip 20*b*, as previously mentioned. The adhesive selected for this particular purpose has the characteristic of forming bonds between the liner membrane and the carton zipper strip which are strong at normal room temperature but which are very weak and fragile at or about 0° F., which is the temperature at which ice cream is normally stored. For this reason, the bond between the liner and the zipper strip is sufficiently strong to maintain the integrity of the assembly during all manufacturing, shipping storage, set-up, filling and sealing operations performed on the carton blank prior to its exposure to the very cold atmosphere of the hard freezing procedure previously mentioned. When the ice cream is maintained at or about 0° F. for a period of time, however, the adhesive fails to maintain a strong bond between the liner 32 and the zipper strip portion 20*b* of the front cover panel 20 of the carton. When the zipper strip 20*b* is being removed, as shown in FIG. 2, the adhesive bond fails completely and the zipper strip 20*b* is readily removed without altering the position of the underlying portion of the film 32.

A variety of thin, flexible sheet materials may be utilized in the practice of this invention including plastic films such as polyethylene, polypropylene, polyamide, polyesters, polyvinyl chloride, polyvinylidine chloride, polystyrene, regenerated cellulose coated with a moisture-resistant coating, cellulose acetate and others. Also suitable for this use are aluminum foil and paper webs coated with a variety of water-resistant coatings, as well as laminates or composite sheet materials which do not absorb appreciable amounts of moisture or lose their strength or flexibility under the conditions normally associated with ice cream storage. The particular adhesive which is selected for the adhesion of the liner sheet to the interior surface of the zipper strip 20*b* will, of course, be influenced both by the surface characteristics of the pellicle selected and by the carton surface to which it is being adhered, and such choice will, then, be dictated by routine adhesion tests conducted at room temperature and at freezer storage temperatures. In a preferred embodiment of the invention, the liner membrane used is polypropylene, the interior surface of the paperboard carton is wax coated and the adhesive may be an acrylic latex type adhesive, a styrene-butadiene latex or a polyvinyl acetate adhesive, the latter being preferred. A particularly satisfactory proprietary adhesive composition of the polyvinyl acetate type is sold by Findley Adhesives, Inc. of Milwaukee, Wisconsin under the Code Number 6245-358.

As previously noted, as soon as the zipper strip portion 20*b* of front cover panel 20 is removed, the cover may be lifted to reveal the top surface of the ice cream, covered by membrane 32 which is in intimate contact therewith. The liner 32 may be very easily peeled back, as shown in FIG. 3, to expose the ice cream, which may be spooned or scooped from the container for use by the consumer. In the larger sizes of containers commonly utilized for ice cream in today's market, the entire contents of the container are seldom completely consumed the first time the carton is opened. In the carton of the present invention, the liner sheet may be repositioned over the surface of any ice cream remaining after the desired amount has been removed, as shown in FIG. 5, the cover reclosed and the carton replaced in a frozen storage unit. Due to the flexibility of the liner membrane and the fact that one end of the sheet is unrestrained, the liner may be brought into substantially intimate conformity with the surface of the remaining ice cream in the carton, even though such surface may show considerable irregularity of contour. This fact is instrumental in preventing icing or desiccation of the remaining ice cream, since decreasing the free air space above the surface of the ice cream very substantially reduces the undesirable changes in product quality which normally occur during frozen storage of partially filled containers.

In a modified embodiment of the carton of this invention, as illustrated in FIGS. 6–9, the liner sheet 32 is extended to overlie the entire inner surface of front cover panel 20 and is adhered to the inner surface of the bonding portion 20*c* of front cover panel 20. In this embodiment, the liner sheet 32 is preferably firmly adhered to both the bonding portion 20*c* and to the front wall 12 by adhesive bonds which will not fail under normal frozen food storage conditions. In opening the carton, the removal of the detachable zipper strip 20*b* enables the cover assembly to be raised in the customary manner with the severance of weakness lines 31 on the cover end skirt panels 28, as previously described. Bonding portion 20*c* and the adhered liner sheet 32 may then be detached from their adhesive connection to front wall 12, as is shown in process in FIG. 7 and FIG. 9, and the liner sheet peeled back to expose the carton contents for removal.

The separation of the film liner sheet from its adhesive bond to the front wall 12 is facilitated if at least a portion of the front wall area covered by the adhesive is circumscribed by one or a plurality of closed cut score lines 40 impressed in the outer wall surface and extending inward partway through the carton wall in known manner. Removal of the liner sheet will thereby cause ply separation in the front wall structure with removal of the outer ply of the wall in the circumscribed areas, the removed material 42 remaining adhered to the inner surface of the liner sheet as shown in FIGS. 7 and 9.

The construction of the present invention as herein described provides a carton for frozen products such as ice cream, the cover assembly of the carton being easy to open without damage thereto by virtue of a liner membrane which is interposed between the carton cover and the top surface of the ice cream. Furthermore, the liner sheet, after removal of a portion of the ice cream from the carton, may be replaced in intimate contact with the remaining carton contents and the liner will thereby help to prevent or minimize the deleterious changes which occur on storage of ice cream in containers which are only partially full of the product and which therefore have free air space in the container above the ice cream surface.

It is to be understood that the constructions specifically described herein are intended to be illustrative of the present invention without being restrictive, and reference should be made to the appended claims in determining the full scope of the invention.

I claim:

1. A paperboard carton for ice cream comprising a front wall, a bottom wall, a rear wall, opposed end walls and a top cover panel hingedly attached along one edge to the upper edge of the back wall and having a front cover panel hingedly attached to the opposite edge of said top cover panel and overlapping the upper portion of the front wall when the carton is erected, said front cover panel being separated by a pair of spaced upper and lower weakness lines substantially parallel to the hinge line between said top cover panel and said front cover panel into an upper cover front skirt portion, an intermediate detachable portion and a lower bonding portion adhesively bonded to said front wall, and a flexible, water-resistant liner sheet adhered along one edge thereof to the interior surface of said back wall, said sheet extending to substantially completely cover the interior surface of said top cover panel and being adhered along the opposite edge thereof to the inner surface of said front cover panel in an area below said upper weakness line.

2. A carton according to claim 1 wherein said liner sheet is adhered to the detachable portion of said front cover panel by an adhesive bond which is readily fracturable at normal frozen food storage temperatures.

3. A carton according to claim 1 wherein said liner sheet is a flexible plastic web.

4. A carton according to claim 3 wherein said liner sheet is polypropylene.

5. A carton comprising a receptacle portion including a receptacle front wall, a bottom wall, a rear wall and opposed receptacle end walls, and a cover assembly including a top cover panel hingedly connected to the upper edge of said receptacle rear wall, a front cover panel hingedly attached to and depending from the edge of said top cover panel remote from its hinge connection to said rear wall, and a pair of cover end skirt panels, each connected by a hinge score line to a respective end edge of said top cover panel, corner glue tabs adhesively connecting said cover front panel with said respective cover end skirt panels to form corners of the cover, said cover front panel including an upper cover front skirt portion, a lower marginal bonding portion for adhesive connection with said receptacle front wall, and an intermediate, detachable zipper strip portion defined by a pair of fracturable lines of weakness joining said detachable portion to said upper cover front skirt portion and to said lower bonding portion, respectively, of said cover front panel, a flexible, water-resistant liner sheet substantially covering the inside surface of said top cover panel, the upper portion of said receptacle rear wall, said upper cover front skirt portion and said intermediate detachable portion of said cover front panel and being adhered along a first edge thereof to the interior surface of said rear wall close to the hinge line connection between said rear wall and said top cover panel, and adhered along its opposite edge to the interior surface of said detachable portion of said front cover panel by an adhesive bond which is readily fracturable at normal frozen food storage temperatures.

* * * * *